US008151592B2

(12) United States Patent
Badia et al.

(10) Patent No.: US 8,151,592 B2
(45) Date of Patent: Apr. 10, 2012

(54) DEVICE FOR CONTROLLING A CONDENSATE REMOVAL PUMP

(75) Inventors: Olivier Badia, Dammarie-les-Lys (FR); Antoine Chauvin, Saint Maurice (FR); Michel Mesrouze, Champigny (FR)

(73) Assignee: Sauermann Industrie, Chevry-Crossigny (FR)

( * ) Notice: Subject to any disclaimer, the term of this patent is extended or adjusted under 35 U.S.C. 154(b) by 492 days.

(21) Appl. No.: 12/497,821

(22) Filed: Jul. 6, 2009
(Under 37 CFR 1.47)

(65) Prior Publication Data

US 2010/0089086 A1 Apr. 15, 2010

(30) Foreign Application Priority Data

Jul. 4, 2008 (FR) ..... 08 54562

(51) Int. Cl.
*F25D 21/14* (2006.01)

(52) U.S. Cl. ..... 62/285; 62/291

(58) Field of Classification Search ..... 62/291, 62/285, 188, 280; 417/40, 126, 331, 107
See application file for complete search history.

(56) References Cited

U.S. PATENT DOCUMENTS

| | | | | |
|---|---|---|---|---|
| 2,349,522 | A | 5/1944 | Scofield | |
| 2,465,516 | A | 3/1949 | Colyer et al. | |
| 3,708,637 | A | 1/1973 | Krueger et al. | |
| 5,271,237 | A * | 12/1993 | Popelka et al. | 62/179 |
| 5,493,086 | A | 2/1996 | Murphy, Jr. et al. | |
| 6,129,110 | A * | 10/2000 | Kolb | 137/391 |
| 6,322,326 | B1 * | 11/2001 | Davis et al. | 417/40 |
| 6,460,364 | B1 * | 10/2002 | Tufo | 62/285 |
| 6,817,194 | B1 * | 11/2004 | Leach | 62/150 |
| 6,976,367 | B2 * | 12/2005 | Spanger | 62/129 |
| 7,217,343 | B2 * | 5/2007 | Land | 203/1 |
| 7,252,482 | B2 * | 8/2007 | Walker et al. | 417/40 |
| 2005/0040024 | A1 * | 2/2005 | Land | 202/176 |
| 2005/0138939 | A1 * | 6/2005 | Spanger | 62/150 |
| 2006/0045771 | A1 * | 3/2006 | Walker et al. | 417/423.1 |
| 2007/0039345 | A1 * | 2/2007 | Forsberg et al. | 62/285 |
| 2007/0224050 | A1 * | 9/2007 | Ward | 417/41 |
| 2007/0272539 | A1 * | 11/2007 | Land | 203/10 |

FOREIGN PATENT DOCUMENTS

| | | |
|---|---|---|
| DE | 40 23 611 A1 | 2/1992 |
| DE | 93 02 311 U1 | 6/1993 |

* cited by examiner

*Primary Examiner* — Mohammad Ali
(74) *Attorney, Agent, or Firm* — Hamre, Schumann, Mueller & Larson, P.C.

(57) ABSTRACT

This invention relates to a device for controlling a condensate removal pump, including:

a float (102) intended to be placed in a container (20), capable of moving according to the level of condensate in the container, an actuation element (130) driven by the movement of said float (102), wherein said actuation element is configured and mounted so as to act selectively on a first and a second microswitch (110, 120) respectively having a first and a second pushbutton (112, 122) mobile between two positions, so as to define three distinct states:

a resting state, in which said pump is stopped, wherein said first pushbutton (112) is in a first position ensuring the stopping of said pump and said section pushbutton (122) is in a second position;

an active state, in which said pump is activated, wherein said first pushbutton (112) is in a second position ensuring the implementation of said pump, and said second pushbutton (122) remains in its second position;

an alarm state, in which a safety action is activated, wherein said first pushbutton (112) remains in its second position ensuring the implementation of said pump and said second pushbutton (122) is in a first position ensuring the activation of a safety action.

13 Claims, 6 Drawing Sheets

DEVICE FOR CONTROLLING A CONDENSATE REMOVAL PUMP

FIELD OF THE INVENTION

The invention relates to the control, or management, of a condensate removal pump. More specifically, the invention relates to the detection of condensate levels, in a container, and the control of a pumping system according to these levels.

Such condensate removal pumps are implemented in particular in air conditioning systems, refrigeration systems, ventilation systems or heating systems.

A number of techniques for producing a device for detecting condensate levels and controlling the pump are already known. It is particularly known to provide a float, floating in a container, and cooperating with detection and/or actuation means, according to the condensate level in the container.

The invention relates, according to one aspect, to a liquid level detection device of this type, comprising a float intended to be placed in a container, capable of moving according to the level of liquid in the container, and an actuation element driven by said float.

A removal pump can, in particular, be used in an air conditioning system in which it is desirable to regularly remove, by pumping, the liquid (or condensate) resulting from condensation of the water vapor present in the ambient air that is cooled and which is collected in a container. This enables overflow of said container to be avoided and the amount of stagnant water in said container to be limited.

Thus, in an air conditioning system including a detection device of the type mentioned above, when the height of the liquid rises to the maximum level allowed, the float rises and drives the actuation element. According to one approach, this actuation element can act on a monostable microswitch, having a pushbutton. For example, when the level reached is a maximum level (Ma) at which point the pump should be turned on, the actuation element can be arranged so as to press or release said pushbutton of the microswitch. The microswitch then changes states and controls the turning on of a pump that pumps the liquid into the container. The pump then generally moves this liquid to a wastewater line.

The problem of this solution is that, once the liquid level is at a level slightly lower than the maximum level Ma, the pushbutton returns to its previous state and stops the pump. The container empties therefore very few, and the pump is very often activated and stopped, in the vicinity of the maximum level Ma (i.e. between the maximum level and a substantially lower level).

This solution is of course not optimal, for reasons of safety, efficacy and durability. For this reason, known removal pump control systems distinguish, in addition to the maximum level Ma, a minimum level Mi. The pump is stopped only when this minimum level is reached, thereby enabling substantially regular cycles to be defined (allowing the definition of a delta of pumping, i.e. the difference between the maximum level and the minimum level, that is optimized).

This cannot therefore be achieved efficiently with a monostable microswitch (i.e. capable of adopting a stable position, by default, for example stopping the pump, and an unstable position, when a force is applied on the pushbutton, for example actuating the pump), unless accepting a very low delta of pumping. It is of course possible to use a bistable microswitch. However, they are more expensive, and it would then be necessary to provide a specific actuation in order to control the stopping of the pump, when the minimum level is reached.

In condensate removal pumps, numerous constraints must be taken into account. They must be inexpensive, easy to assemble and, depending on the case, easy to adjust, have a low profile and require little or no intervention or maintenance.

Moreover, in this type of system, it is possible for example for the pump to be clogged or unserviceable, for a line to be clogged or pinched, for the first microswitch to be unserviceable, or for the inflow of liquid into the container to be abnormally high. In this type of situation, the liquid is no longer pumped, or not pumped quickly enough, and the height of the liquid inside the container rises beyond the maximum level allowed. The liquid then risks overflowing from the container.

Specific detection of a safety or danger level, above the maximum level, is therefore generally provided.

OBJECTIVES OF THE INVENTION

The invention is intended in particular to propose a device for controlling a condensate removal pump that is safe, simple, reliable and/or inexpensive.

In particular, the invention is intended to propose such a control device capable of detecting at least three distinct levels (minimum level, maximum level and safety level).

DESCRIPTION OF THE INVENTION

The invention relates, according to one of its aspects, to a device for controlling a condensate removal pump, comprising:

- a float intended to be placed in a container, capable of moving according to the level of condensate in the container,
- an actuation element, also called a pivoting arm, driven by the movement of said float.

According to the invention, said actuation element is configured and mounted so as to act selectively on a first and a second microswitch respectively having a first and a second pushbutton mobile between two positions, so as to define three distinct states:

- a resting state, in which said pump is stopped, wherein said first pushbutton is in a first position ensuring the stopping of said pump and said section pushbutton is in a second position;
- an active state, in which said pump is activated, wherein said first pushbutton is in a second position ensuring the implementation of said pump, and said second pushbutton remains in its second position;
- an alarm state, in which a safety action is activated, wherein said first pushbutton remains in its second position ensuring the implementation of said pump and said second pushbutton is in a first position ensuring the activation of a safety action.

Said actuation element can in particular be configured and mounted so that said device switches:

- from said resting state to said active state when said condensate level rises and reaches a predefined maximum level (Ma);
- from said active state to said resting state when said condensate level falls and reaches a minimum predefined level (Mi), below said maximum level (Ma);
- from said active state to said alarm state when said condensate level reaches a safety level (ns) above said maximum level (Ma).

Thus, with only two microswitches, the invention enables the pump to be controlled so that it remains on between the maximum level (the starting of the pump having been engaged when said level was reached) and the minimum level. Conversely, the pump, stopped when the minimum level has been reached, remains stopped until the maximum level is again reached. The detection of the alarm level is also ensured.

Said microswitches can in particular be monostable microswitches, wherein said first position is a stable position and said second position is an unstable position.

Said actuation element can have stabilization means cooperating with at least said first pushbutton in order to hold it in its unstable position while said condensate level falls, and is above said predefined minimum level (Mi).

Thus, the pushbutton remains pressed, while the level falls. There is therefore a decorrelation between the movement of the float and the actuation element, while the condensate level falls. In other words, the correlation between the movement of the float and that of the actuation element is not permanent, but instead selective.

The stabilization means can, for example, comprise a friction surface, ensuring that the actuation element remains in a substantially fixed transient position, while the condensate level falls.

The stabilization means can, alternatively or in combination, comprise at least one magnet.

Said first and second microswitches can be mounted so that said actuation element is held, when the device is in the active state, by said pushbuttons.

The safety action can be chosen among at least one of the followings: stopping of the machine producing condensate, generation of an alarm, for example a sound or visual alarm, and activation of a second pump. This list is non-limiting.

According to a specific embodiment, the actuation element can pivot around a pivot and includes a first arm portion located on a same side of said pivot.

The first and second microswitches can define, between their pushbuttons, a gap, and the first actuation element portion may be housed in this gap.

The first and second pushbuttons can be arranged opposite one another.

The first and second microswitches can be identical or quasi-identical.

The device for controlling a condensate removal pump can include two stop elements apart at a distance from one another and separated by an empty space in which a second portion of the actuation element is located, and these stop elements are driven by the movement of the float and in turn drive the actuation element.

The invention also relates, according to another aspect, to an air conditioning or heating system including a liquid collection container, equipped with a device for controlling a condensate removal pump as defined above.

LIST OF FIGURES

Other features and advantages of the invention will appear in the following detailed description of specific embodiments of the invention provided by way of non-limiting examples. This description refers to the appended drawings in which:

FIG. 1 diagrammatically shows an example of a pumping system according to the invention;

FIG. 2 is a detail view of the detection device of the system of FIG. 1;

FIG. 3 diagrammatically shows an example of an air conditioning system including the pumping system of FIG. 1;

DESCRIPTION OF SPECIFIC EMBODIMENTS OF THE INVENTION

Figure 2:
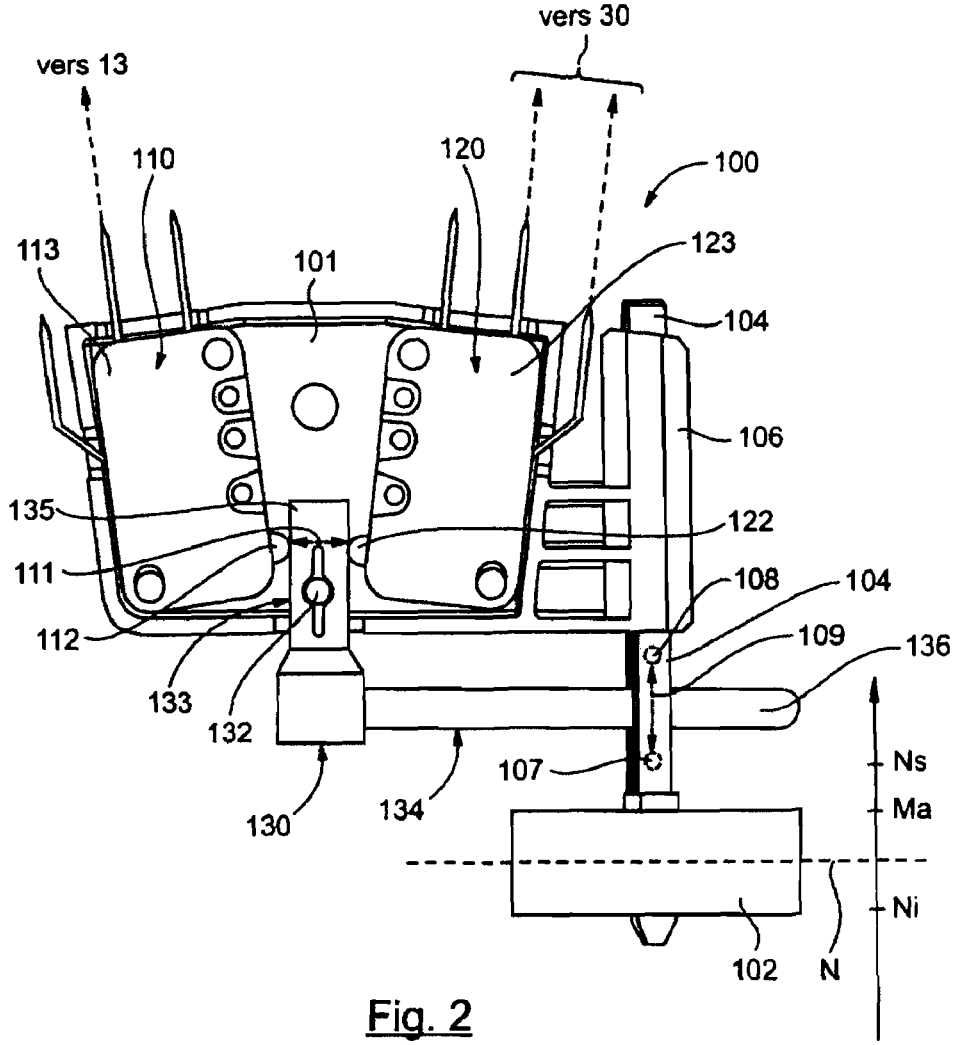

Main Features of the Embodiment of FIG. 2

FIG. 2 shows an example of a device for detecting a liquid level according to the invention, including a first and a second microswitch, in which the latter has a second pushbutton mobile between a raised stable position and a pressed unstable position, in which said pivoting arm presses more or less on the second pushbutton when the level of liquid in the container varies, so that the second microswitch changes states when the liquid level reaches a safety level, above the maximum level allowed.

Figure 3:
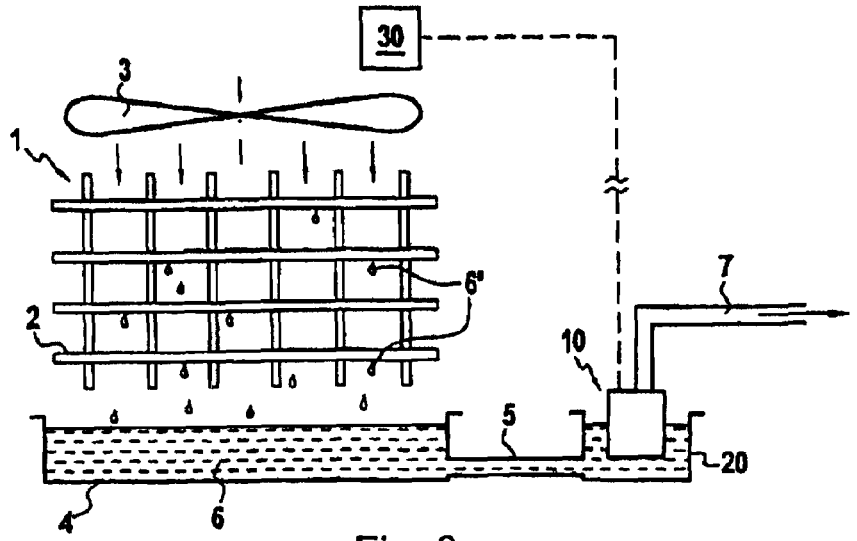

This device can in particular be implemented in the liquid pumping system of FIG. 3, including:

- a pump capable of pumping a liquid into a container,
- a safety system,
- a device for detecting the level of liquid in said container according to the invention, and in which:

- the first microswitch controls the activation of the pump when the liquid level reaches a maximum level allowed, and
- the second microswitch controls the activation of the safety system when the liquid level reaches a safety level, above the maximum level allowed.

Thus, when the height of the liquid rises beyond the maximum level allowed, the float rises and drives the pivoting arm, which presses or releases the second pushbutton. Once the safety level has been reached, the second microswitch changes states and controls the activation of the safety system.

When used in an air conditioning system, the safety system can, for example, warn a person of the risk of overflow of the container and/or cut off the arrival of cold water in the heat exchanger of the air conditioning system and/or cut off the electrical power supply of the air conditioning system. The risk of overflow of the liquid is thus considerably reduced.

In addition, the same pivoting arm is used to press on the first and second pushbuttons and cause the states of the first and second microswitches to be changed. This has the advantage of limiting the number of parts of the device and therefore of limiting the cost and bulk of same.

According to an embodiment, the device is such that:

- the pivoting arm pivots around a pivot and includes a first arm portion located on the same side as said pivot,
- the first and second microswitches are arranged so as to define, between their pushbuttons, a gap, in which the first arm portion is housed in this gap.

This particular arrangement has the advantage of further limiting the bulk of the device.

According to an embodiment, the pushbuttons of the microswitches are arranged opposite one another.

This particular arrangement has the advantage of further limiting the bulk of the device, as well as of balancing the forces exerted on each side of the pivoting arm, thus reducing the force exerted on the float by the pivoting arm.

According to an embodiment, the first and second microswitches are identical or quasi-identical (they can, for example, be different colors), thereby enabling one to manage only a single set of microswitches in the production of the device, enabling this production to be simplified by limiting the risks of assembly error (by preventing problems of inversion of the first and second microswitches) and enabling the cost of the device to be limited in principle.

According to an embodiment, the pumping system is such that:

- the first microswitch controls the activation of the pump when the first pushbutton switches to the pressed position, and controls the stopping of the pump when the first pushbutton switches to the raised position, and
- the second microswitch controls the activation of the safety system when the second pushbutton switches to the raised position.

According to an embodiment of the invention, the detection device includes two stop elements at a distance from one another and separated by an empty space in which a second portion of the pivoting arm is located, in which these stop elements are driven by the movement of the float and in turn drive the pivoting arm.

The two stop elements at a distance from one another enable, when the pump is activated and the level of liquid in the container falls, the movement of the float (which follows the liquid level) to be prevented from immediately driving the pivoting arm and therefore the actuation of the first microswitch and the stopping of the pump. Conversely, these two stop elements enable, when the pump stops and the level of liquid in the container rises, the movement of the float to be prevented from immediately causing the activation of the pump. The mode of operation of these two stop elements is described in detail and illustrated below.

The two stop elements are fully effective if the pivoting arm is capable of remaining in a transient position when it is not driven by one of the stop elements. However, the pivoting arm is generally subjected to disruptive forces, in particular its own weight, which move the pivoting arm away from this transient position. It is noted that to limit the influence of the weight of the pivoting arm, this arm is advantageously made of a lightweight material.

To oppose these disruptive forces, according to an embodiment, the device includes stabilization means enabling the pivoting arm to be stabilized in a transient position.

Said stabilization means can have various shapes and various modes of action.

According to an embodiment, the stabilization means slow the movement of the pivoting arm by generating frictional forces. When the pivoting arm is in a transient position, these frictional forces opposite said disruptive forces. For example, the stabilization means include a material with a high friction coefficient arranged between the pivoting arm and the pivot of said arm, so as to generate frictional forces between the arm and its pivot.

According to another embodiment, the stabilization means generate anchoring forces that opposite said disruptive forces when the pivoting arm is in a transient position. For example, the stabilization means include a magnet arranged at the level of said transient position and the pivoting arm is magnetic or has a magnet.

It is noted that the frictional forces or the anchoring forces mentioned above must be capable of being overcome by the driving forces exerted by the stop elements on the pivoting arm.

The detection device and the pumping system of the invention can be used in various systems and, in particular, in an air conditioning system or in a heating system such as a condensing boiler.

The invention also relates to a heating or air conditioning system including a liquid or condensate collection container equipped with a system for pumping this liquid according to the invention.

Generally, in air conditioning or heating systems, the space allocated to the pumping system is restricted for reasons of overall bulk of the system and/or for aesthetic reasons. One will therefore understand the benefit of having a low-profile pumping system (in particular owing to its vertical movement) like that of the invention.

Example of a Pumping System

Figure 1:
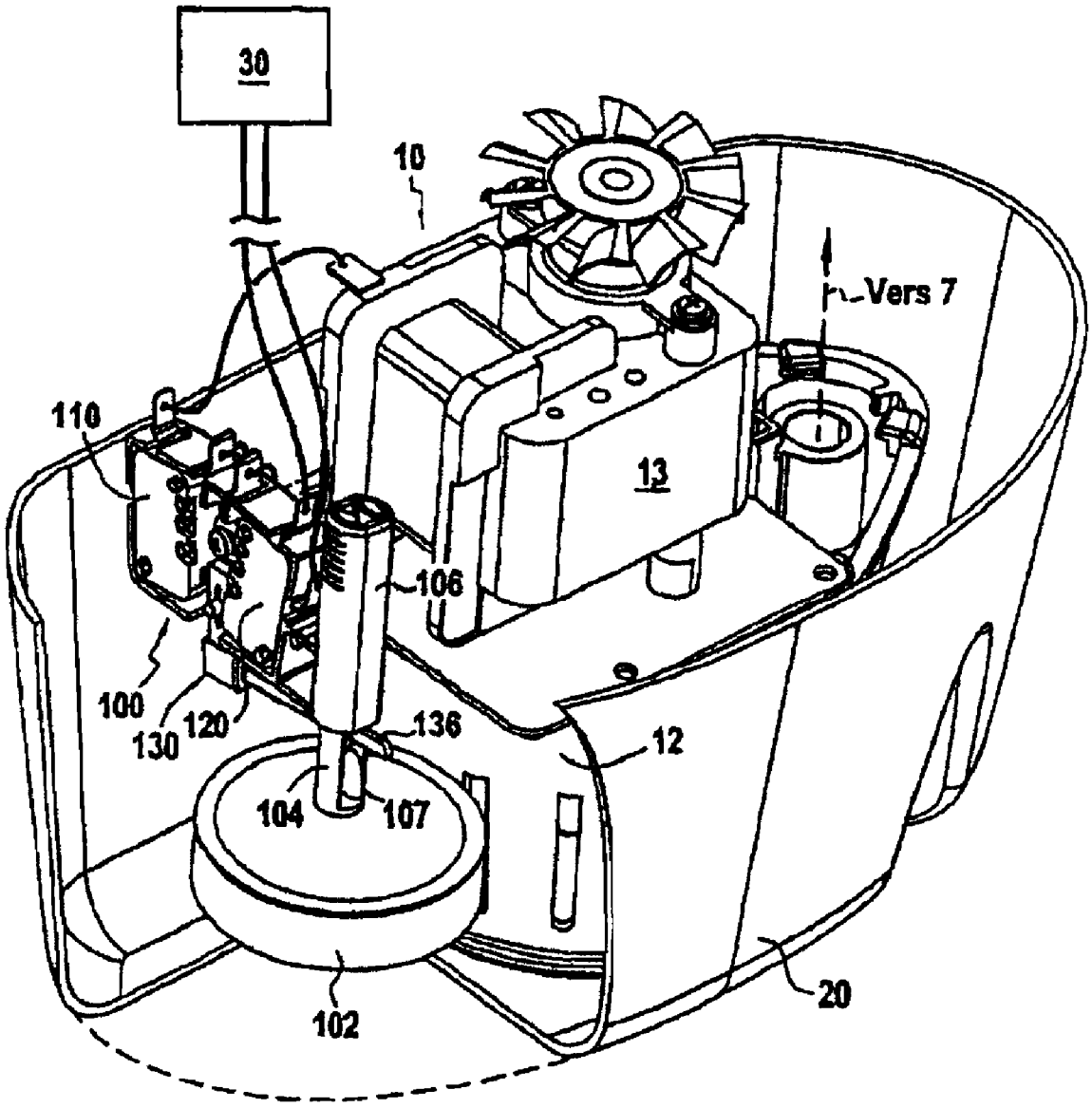

FIG. 1 shows an example of a pumping system 10 according to the invention. This system 10 is placed inside a container 20 and enables detection and pumping of the liquid collected in the container 20. The liquid enters the container 20 via an inlet (not shown).

The system 10 includes:

- a hydraulic pump 12 (in this example, it is a centrifugal pump) capable of pumping liquid into the container 20 via a suction hole (not shown), this pump being driven by an electric motor 13,
- a safety system 30, and
- a device 100 for controlling the pump, or detecting the level of liquid in the container 20, shown in detail in FIG. 2.

First Example of a Control Device

The device 100 includes:

- a float 102 placed in the container 20 and capable of moving from downwards and upwards according to the level of liquid in the container 20,
- a first microswitch 110 controlling the activation/stopping of the pump 12, in which this first microswitch has a first pushbutton 112 mobile between a stable raised position and an unstable pressed position,
- a second microswitch 120 controlling the activation of the safety system 30, in which this second microswitch has a second pushbutton 122 mobile between a stable raised position and an unstable pressed position,
- a pivoting arm 130 driven by the movement of the float 102, in which this pivoting arm is in contact with pushbuttons 112, 122 and first and second microswitches 110, 120, and exerts a more or less high pressure on them according to the position of the float 102 and therefore the height of liquid in the container 20.

Below, the horizontal direction of reference is that of the level of liquid in the container 20, shown with a dotted line in FIG. 2 and designated by the letter N.

The float 102 is secured by a rod 104, guided vertically in translation by at least one guide element. In the example, this guide element is a guide sleeve 106 outside the rod 104. The guide element can also be a rail, or a slide. The rod 104 has two stop elements remote from one another according to the vertical direction: a bottom stop element 107 and a top stop element 108. These stop elements 107, 108 mutually define an empty space, or a gap 109.

The pivoting arm 130 pivots around a cylindrical pivot 132. It has a general "L" shape with a small branch 133 and a large branch 134 substantially perpendicular to one another. The small branch 133 is more vertically oriented and the large branch 134 is therefore more horizontally oriented. The pivot 132 passes through the central portion of the small branch 133. The pivoting arm 130 has a first arm portion 135 located on the same side as the pivot 132 above it. This first arm portion 135 belongs to the small branch 133. The pivoting arm 130 also has a second arm portion 136 located between the stop elements 107 and 108, in the gap 109. This second arm portion 136 corresponds to the end portion of the large branch 134.

The small branch 133 is made of a material with a high friction coefficient, for example rubber, so that frictional forces appear when the pivoting arm 130 moves with respect to the pivot 132, thereby slowing the movement of the pivoting arm 130 and enabling it to be stabilized in a transient position when it is not driven by one of the stop elements 107 or 108. The small branch 133 of the pivoting arm 130 therefore forms stabilization means in the sense of the invention, due to the fact that it is made of a material with a high friction coefficient.

The first and second microswitches 110, 120 are both mounted on a plate 101 made in one piece with said guide element (i.e. the guide sleeve 106). These microswitches 110, 120 are arranged so as to define a gap 111 between their pushbuttons 112, 122. The first arm portion 135 is housed in this gap. The pushbuttons 112, 122 of the first and second microswitches 110, 120 are arranged opposite one another, the first arm portion 135 being centered with respect to its microswitches when it is in a substantially vertical position. Concretely, in reference to FIG. 2, the pushbutton 112 of the first microswitch 110 is located at the lower left-hand portion of the housing 113 of the microswitch 110, whereas the pushbutton 122 of the second microswitch 120 is located at the lower right-hand portion of the housing 123 of the microswitch 120. As the first and second microswitches 110, 120 are, in the example, identical or quasi-identical, it should be understood that these are the front and rear respective faces of the housings 113, 123 of the microswitches, which appear in FIG. 2.

In the example, when the first arm portion 135 is vertically oriented, it is in contact with the two pushbuttons 112, 122. In other words, the distance between the two pushbuttons 112, 122, when they are both in their raised position, is shorter than the width of the first arm portion 135.

The first microswitch 110 is connected to the electric motor 13 and controls the activation of the motor 13, and therefore of the pump 12, when the first pushbutton 112 switches to the pressed position. In addition, it controls the stopping of the motor 13, and therefore of the pump 12, when the first pushbutton 112 switches to the raised position.

The second microswitch 120 controls the activation of the safety system 30 when the second pushbutton 122 switches to the raised position.

In reference to FIG. 2, we will now describe the operation of the detection device 100 and the pumping system 10.

When the liquid level N rises, the float 102 rises and the bottom stop element 107 pushes the second portion 136 of the pivoting arm 130 upward. As the force exerted by the stop element 107 is greater than the frictional forces between the pivoting arm 130 and its pivot 132, the arm 130 pivots. The first portion 135 of the pivoting arm 130 then moves to the left (in reference to FIG. 2) and presses on the first pushbutton 112, which is pressed down. When the liquid level N reaches a maximum level allowed Ma, the first microswitch 110 changes states and controls the activation of the motor 13 and the pump 12.

It is noted that, over time, the first portion 135 of the pivoting arm 130 releases the pressure exerted on the second pushbutton 122 which rises spontaneously to its raised position under the effect of return means working in compression, housed in the housing 123, but it does not release this pushbutton 122 enough for the second microswitch 120 to change states.

With the pump 12 activated, the liquid level N and the float 102 go back down. Insofar as the top stop element 108 does not come into contact with the arm portion 136, the pivoting arm 130 remains in the position that it occupied, this position being a transient position in the sense of the invention. This is possible owing to the frictional forces between the arm 130 and its pivot 132, which oppose, in particular, the weight of the arm 130. In addition, it is noted that the forces exerted by the pushbuttons 112 and 122 on the arm 130 oppose one another, at least partially, thereby enabling the disrupting effect of these forces to be limited.

When the top stop element 108 pushes the second portion 136 of the pivoting arm 130 downward, the force exerted by the stop element 108 is greater than the frictional forces and the arm 130 pivots. The first portion 135 of the pivoting arm 130 then moves to the right (in reference to FIG. 2) and releases the first pushbutton 112, which then spontaneously goes back up to its raised position under the effect of return means working in compression, housed in the housing 113. When the liquid level N reaches a minimum level allowed Mi, the first microswitch 110 changes states and controls the stopping of the motor 13 and the pump 12.

The liquid level N will then rise, with the pivoting arm 130 remaining in a transient position, insofar as it is not driven by the bottom stop element 107. A new filling/pumping cycle begins.

As indicated above, it is possible for a malfunction to occur (i.e. no pumping, or insufficient pumping with respect to the volume of liquid arriving in the container) causing the liquid level N to rise above the maximum level allowed Ma. In such a case, the float 102 and the bottom stop element 107 push the second arm portion 136 upward so that the arm 130 pivots. The first arm portion 135 thus moves to the left and increasingly releases the second pushbutton 122, which then spontaneously moves back up to its raised position. When the liquid level N reaches a safety level Ns, the first arm portion 135 sufficiently releases the pushbutton 122 so that the second microswitch 120 changes states and controls the activation of the alarm 30.

FIG. 3 shows an example of an air conditioning system 1 according to the invention including a heat exchanger 2 inside of which a cold fluid (for example water) or coolant, used as an exchanger 2 heat sink, circulates, a fan intended to cause the ambient air to move so as to bring it in contact with the exchanger 2, and a main collection vat 4 for liquid 6 arranged under the exchanger 2. When the more or less humid ambient air is cooled in contact with the exchanger 2, the water vapor contained in the air condenses and droplets 6' form on the external walls of the exchanger 2. These droplets 6' then fall due to gravity into the main collection vat 4.

To pump the condensation liquid 6, the air conditioning system 1 is equipped with a pumping system 10 like that of FIG. 1. This pumping system 10 is placed in a container 20 that communicates with the collection vat 4 by means of a conduit 5. The liquid 6 collected in the main vat 5 moves into the container 20 where it is pumped by the pump 12 and discharged via a discharge conduit 7.

It is noted that the pumping system 10 can be placed directly in the collection vat 4, which, in this case, would be considered to be a container in the sense of the invention.

In this example, the safety system 30 is a system for cutting off the electric power supply of the air conditioning system, enabling the fan 3 in particular to be stopped. This safety system 30 is integrated in the air conditioning system 1. This safety system 30 can be associated with or replaced by other types of safety systems and, in particular, by a light or sound alert system and/or a system for cutting off the fluid supply of the exchanger 2.

Details of the Operation of the First Example

FIGS. 4 to 8 show a more detailed view of the operation of the device for controlling a condensate removal pump according to the invention and as described above.

It should be noted that in the figures, a pushbutton can be in the pressed state when it ranges from being slightly pressed to being fully pressed. In this pressed state of the pushbutton, the associated microswitch is in the unstable state. Simply in order to facilitate the reading and understanding of FIGS. 4 to 8, a pushbutton in the stable position is shown in white and a pushbutton in the unstable position is shown in black (with the understanding that there is in reality no change in color or the like).

Figure 4:
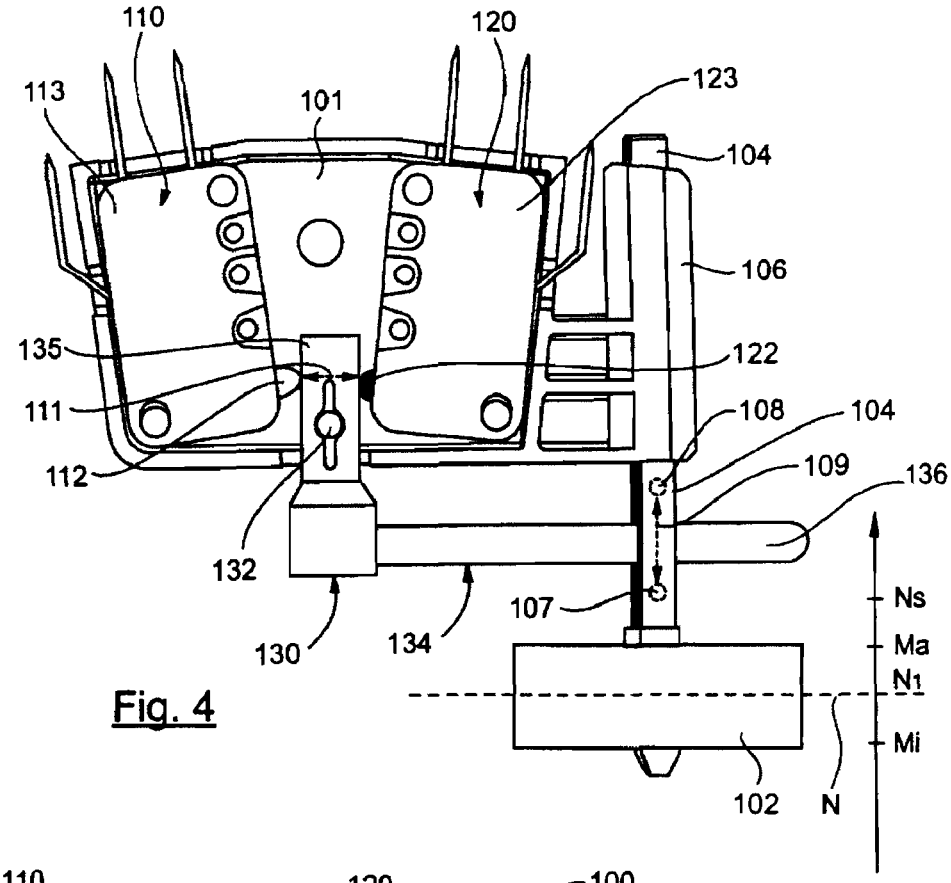
FIG. 4 is a diagrammatic view of the device for controlling the condensate removal pump according to the invention when the float rises to a level N=N1.
Figure 5:
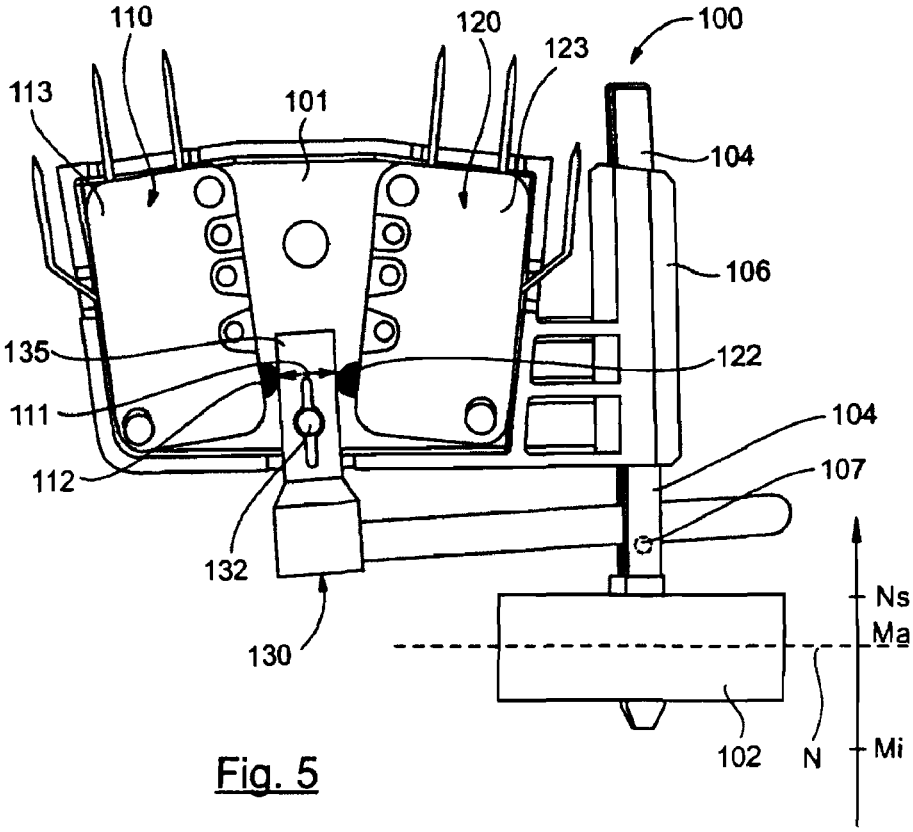
FIG. 5 is a diagrammatic view similar to FIG. 4, in which the float has reached a level N=Ma.

In FIG. 4, the float 102 has risen to a level N=N1, this level being higher than the level Mi and lower than the level Ma. The pivoting arm or actuation element 130 presses on the pushbuttons as shown, with the second pushbutton 122 being in the unstable pressed state while the first pushbutton 112 is raised and stable. The device is in a resting state (the pump is stopped).

When the float 102 rises to a level N=Ma, the condensate level having risen, the branch 134 of the actuation element 130 is constrained by the bottom stop element 107 and the actuation element 130 pivots around the pivot 132 so as to press the first pushbutton 112, while the second pushbutton 122 remains in the pressed state. The switching of the first pushbutton 112 from the raised state to the pressed state enables the activation of the pump to be controlled so that the condensate level decreases in the container. The device is then in an active state (the pump is on).

Figure 6:
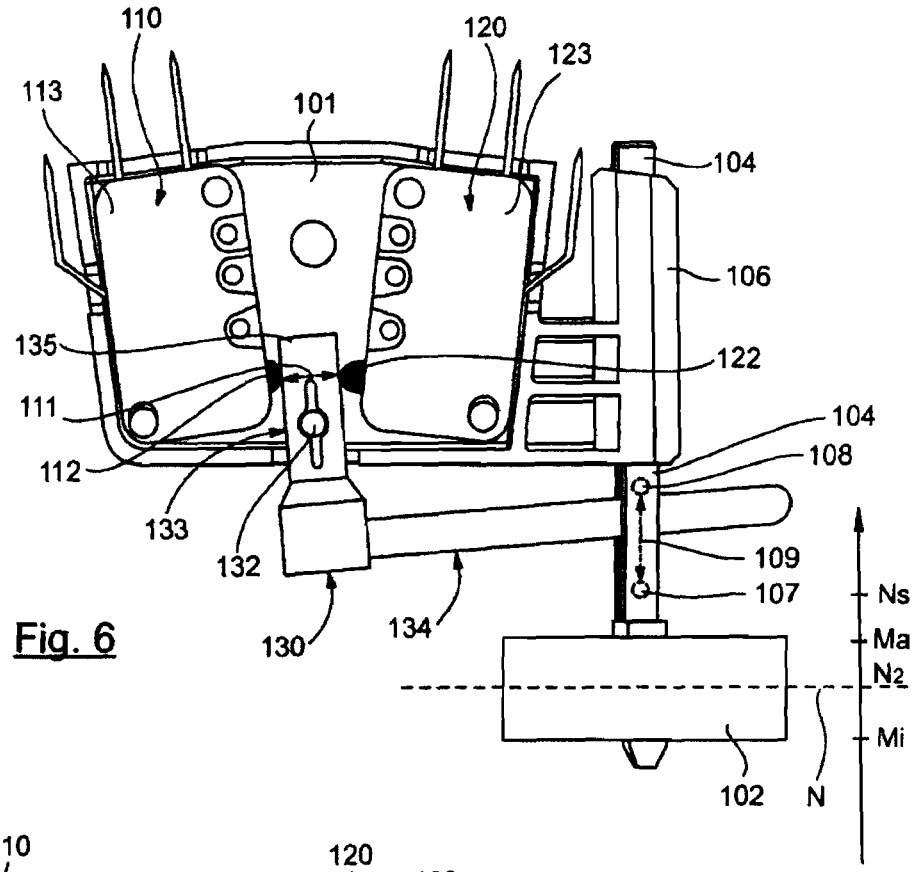
FIG. 6 is a diagrammatic view similar to FIGS. 4 and 5, in which the float has gone back down to a level N=N2.

During this decrease in condensate volume, the actuation element remains in the actuation position of the first pushbutton 112, as shown in FIG. 6 in which the float is at a level N=N2 between Mi and Ma, so that the pump continues to operate, pumping the liquid formed by condensate. The device remains in the active state. Stabilization means formed in this example by a friction surface or a material with a high friction coefficient arranged on the actuation element 130 at the place of contact between the actuation element and the first and second pushbuttons 112 and 122, enable the actuation element 130 to be held in this active provisional state in which the pump is actuated, and the first pushbutton 112 remains pressed.

Figure 7:
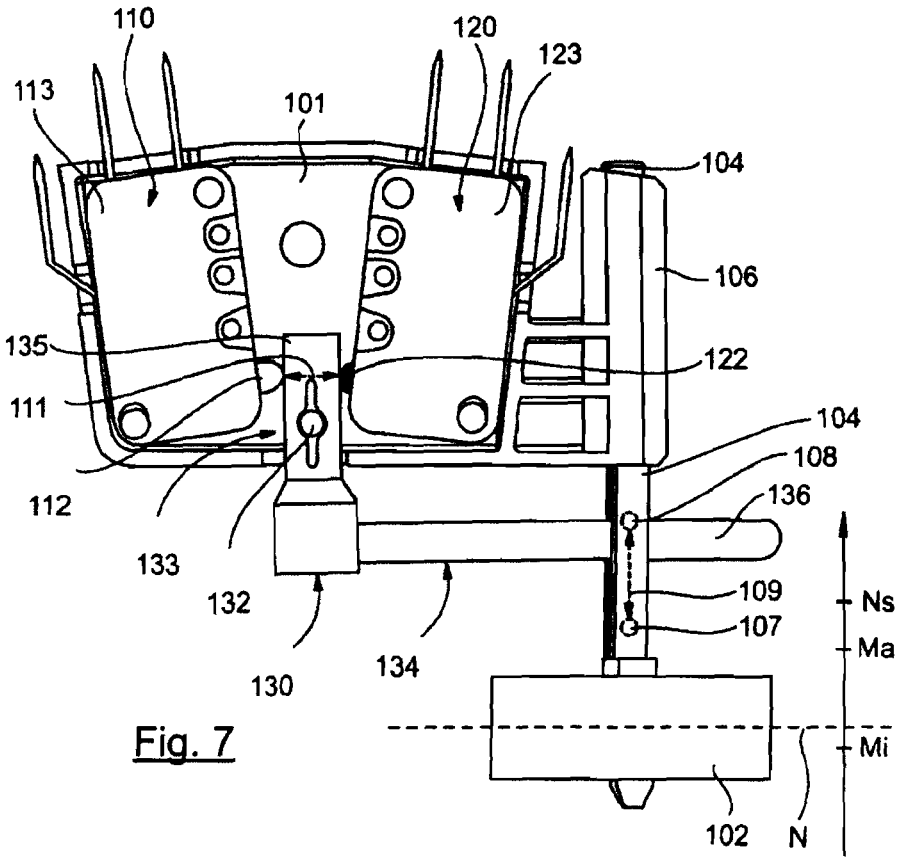
FIG. 7 is a diagrammatic view similar to FIGS. 4 to 6, in which the float has gone back down to a level N close to Mi.

When the level of the float 102 (or condensate) reaches a level N equal to around Mi, the top stop element 108 forces the actuation element 130 to pivot so as to return to a position shown in FIG. 7, in which the first pushbutton 112 is in the raised position, while the second pushbutton is in a pressed position.

During normal operation of the device and the pump, the second microswitch is not activated.

Figure 8:
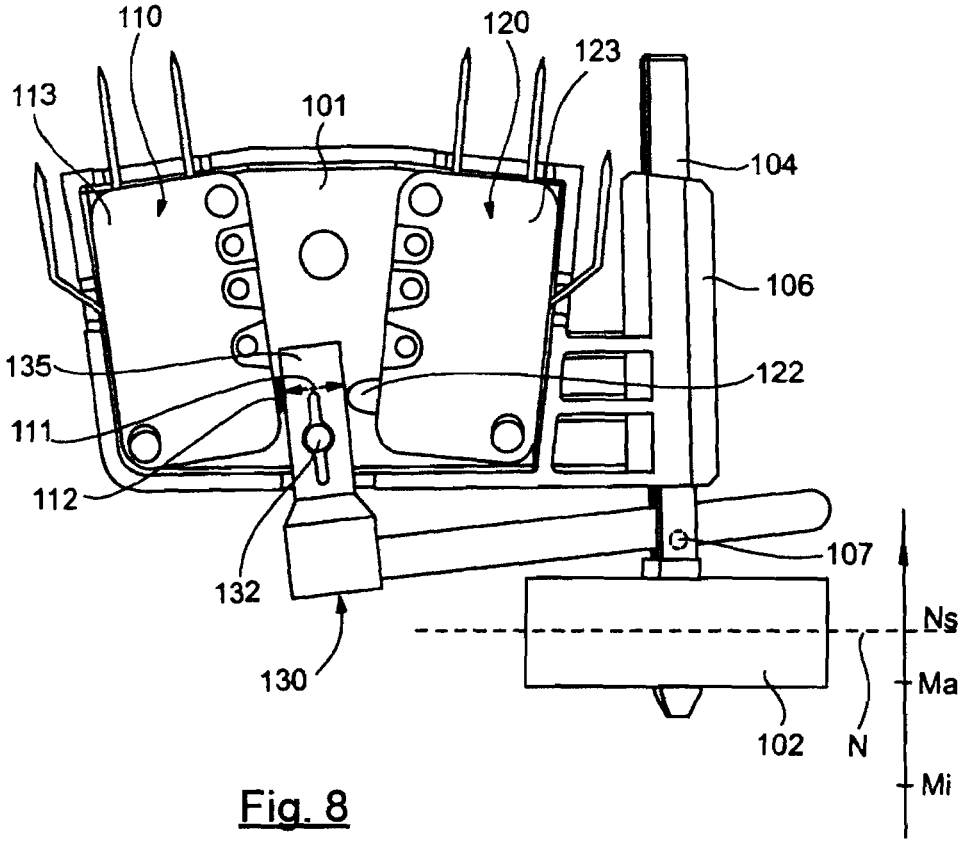
FIG. 8 is a diagrammatic view similar to FIGS. 4 to 7, in which the safety level Ns is reached by the float.

In the event of a malfunction of the device and/or the pump, the condensate level continues to rise in the container. When it reaches a level Ns, as shown in FIG. 8, the actuation element 130 caused to pivot by the bottom stop element 107 reaches a pivoting angle so that the second pushbutton 122 moves to the raised position, whereas it had previously remained in the pressed position, thereby causes the activation of a safety action, for example the stopping of the machine producing the condensate, the generation of an alarm and/or the activation of a second pump. The first pushbutton 112 remains in the unstable state (i.e. sufficiently pressed), and the pump is therefore on.

Other Examples of Implementations and Alternatives

As indicated above, the stabilization means can be formed by something other than a friction surface. FIG. 9 shows a device in which the stabilization means are formed by at least one magnet 150, enabling the actuation element 130 to be held against the first pushbutton 112 insofar as the liquid in the container has not reached a level N=Mi.

Figure 9A:
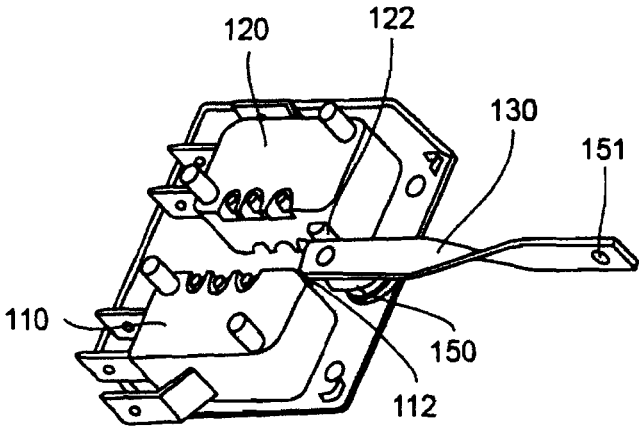
FIG. 9A is a partial diagrammatic perspective view of another example of a device for controlling the condensate removal pump according to the invention.
Figure 9B:
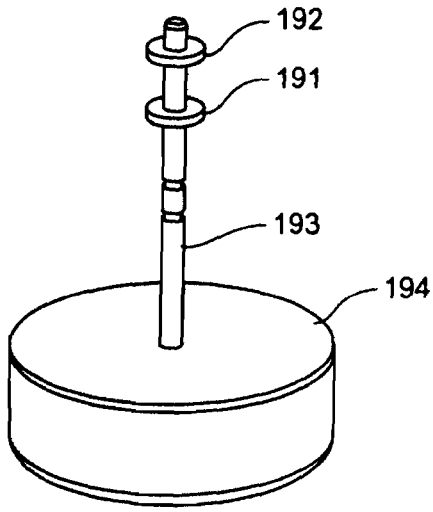
FIG. 9B is a diagrammatic view of the float associated to the device of FIG. 9A.

Also in this example, shown in FIG. 9A, the actuation element 130 of which a portion can be seen in this figure, comprises a flat rod twisted whose free end 151 is moved by the element of FIG. 9B, showing two stop elements 191 and 192 mounted on a rod 193 which is actuated by a float 194.

It is also noted that the microswitches 110 and 120 are placed perpendicularly to those of FIGS. 1 to 8, on the horizontal.

Figure 10:
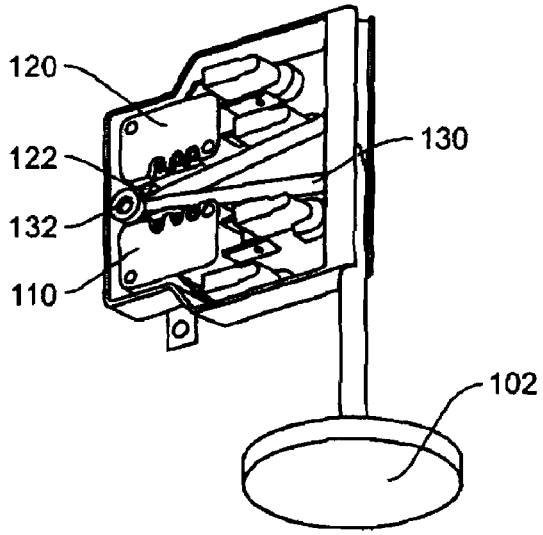
FIG. 10 is a partial diagrammatic perspective view of another example of a device for controlling the condensate removal pump according to the invention.

Also in this horizontal direction, two microswitches 110 and 120 of another device shown in FIG. 10 are shown.

Figure 11:
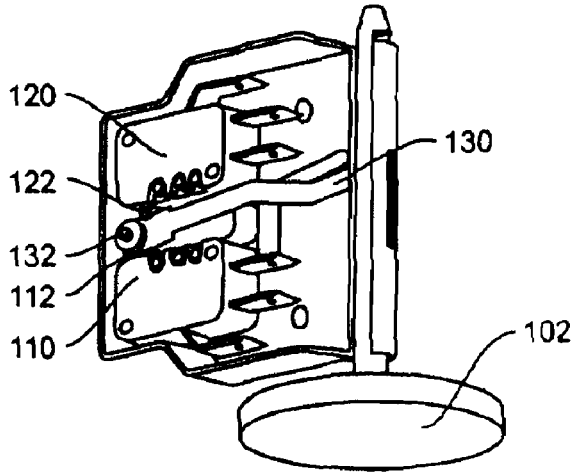
FIG. 11 is a partial diagrammatic perspective view of another example of a device for controlling the condensate removal pump according to the invention.

A device similar to that of FIG. 10 has been shown in FIG. 11, in which the actuation element 130 is bent.

Figure 12:
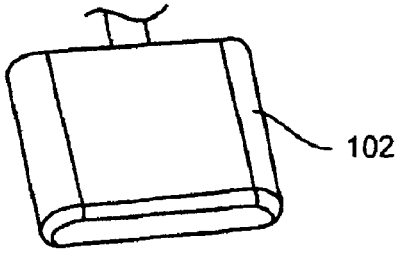
FIG. 12 is a diagrammatic view of another example of a float.

FIG. 12 shows another example of a float 102 that can be used in the device according to the invention, having a bean shape (not shown) from the top view. It is capable of pivoting on itself without nevertheless wedging the actuation element.

Figure 13:
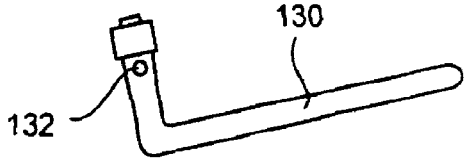
FIG. 13 is a diagrammatic view of another example of a pivoting arm or actuation element.

FIG. 13 shows in isolation an actuation element 130 including a bend, a rigid pivot 132 and a reduced friction surface.

According to other embodiments, not shown, the rod 104 can act directly on the pushbuttons, without the means of a lever. Depending on the case, the size of the float can then be increased, to provide sufficient force to act on the pushbuttons. The rod 4 can, for example, have a ring capable of sliding, remaining immobile while the level falls, until the minimum level is reached. A stop mounted on the rod can then drive the ring, thereby causing the pump to stop.

It is also possible for the rod to be suitable by itself for ensuring the actuation of the pump in the manner desired, for example with a relief suitable for defining cams, acting on pushbuttons according to the level (the distinct actuation between the direction of rising and falling of the level can be ensured by controlled rotation, via these cams, of the rod).

The invention claimed is:

1. Device for controlling a condensate removal pump, comprising:

a float (102) intended to be placed in a container (20), capable of moving according to the level of condensate in the container, an actuation element (130) driven by the movement of said float (102), wherein said actuation element is configured and mounted so as to act selectively on a first and a second microswitch (110, 120) respectively having a first and a second pushbutton (112, 122) mobile between two positions, so as to define three distinct states:

a resting state, in which said pump is stopped, wherein said first pushbutton (112) is in a first position ensuring the stopping of said pump and said second pushbutton (122) is in a second position;

an active state, in which said pump is activated, wherein said first pushbutton (112) is in a second position ensuring the implementation of said pump, and said second pushbutton (122) remains in its second position;

an alarm state, in which a safety action is activated, wherein said first pushbutton (112) remains in its second position ensuring the implementation of said pump and said second pushbutton (122) is in a first position ensuring the activation of a safety action.

2. Device for controlling a condensate removal pump according to claim 1, wherein said actuation element is configured and mounted so that said device switches:

from said resting state to said active state when said condensate level rises and reaches a predefined maximum level (Ma);

from said active state to said resting state when said condensate level falls and reaches a minimum predefined level (Mi), below said maximum level (Ma);

from said active state to said alarm state when said condensate level reaches a safety level (Ns) above said maximum level (Ma).

3. Device for controlling a condensate removal pump according to claim 1, wherein said microswitches are monostable microswitches, wherein said first position is a stable position and said second position is an unstable position.

4. Device for controlling a condensate removal pump according to claim 2, wherein said actuation element has stabilization means cooperating with at least said first pushbutton in order to hold it in its unstable position while said condensate level falls, and is above said predefined minimum level (Mi).

5. Device for controlling a condensate removal pump according to claim 4, wherein the stabilization means comprise at least one friction surface.

6. Device for controlling a condensate removal pump according to claim 4, wherein the stabilization means comprise at least one magnet.

7. Device for controlling a condensate removal pump according to claim 4, wherein said first and second microswitches are mounted so that said actuation element is held, when the device is in the active state, by said pushbuttons.

8. Device for controlling a condensate removal pump according to claim 1, wherein the safety action is chosen among at least one of the followings: stopping of the machine producing condensate, generation of an alarm, and activation of a second pump.

9. Device for controlling a condensate removal pump according to claim 1, wherein:

the actuation element (130) pivots around a pivot (132) and comprises a first arm portion (135) located on a same side of said pivot, the first and second microswitches (110, 120) define, between their pushbuttons (112, 122), a gap (111), and the first portion of the actuation element (135) is housed in said gap.

10. Device for controlling a condensate removal pump according to claim 9, wherein the first and second pushbuttons (112, 122) are arranged opposite one another.

11. Device for controlling a condensate removal pump according to claim 1, wherein the first and second microswitches (110, 120) are identical or quasi-identical.

12. Device for controlling a condensate removal pump according to claim 1, comprising two stop elements (107, 108) at a distance from one another and separated by an empty space (109) in which a second portion (136) of the actuation element is located, and these stop elements (107, 108) are driven by the movement of the float (102) and in turn drive the actuation element (130).

13. Air conditioning or heating system comprising a liquid collection container (20), equipped with a device for controlling a condensate removal pump according to claim 1.

* * * * *